US005297372A

United States Patent [19]

Nicholas

[11] Patent Number: 5,297,372

[45] Date of Patent: Mar. 29, 1994

[54] ELASTOMERIC SEALING SYSTEM FOR ARCHITECTURAL JOINTS

[75] Inventor: John D. Nicholas, Lawrenceville, Ga.

[73] Assignee: Pawling Corporation, Pawling, N.Y.

[21] Appl. No.: 896,477

[22] Filed: Jun. 9, 1992

[51] Int. Cl.[5] ..... E04B 1/68

[52] U.S. Cl. ..... 52/396.07; 52/466; 52/468; 52/461; 52/396.05

[58] Field of Search ..... 52/396, 573, 466, 468, 52/471, 461, 469

[56] References Cited

U.S. PATENT DOCUMENTS

| | | | |
|---|---|---|---|
| 3,300,913 | 1/1967 | Patry et al. | 52/469 |
| 3,849,958 | 11/1974 | Balzer et al. . | |
| 3,974,609 | 6/1976 | Attaway . | |
| 4,022,538 | 5/1977 | Watson et al. . | |
| 4,140,419 | 2/1979 | Puccio | 52/396 |
| 4,221,502 | 9/1980 | Tanikawa | 52/396 |
| 4,295,311 | 10/1981 | Dahlberg . | |
| 4,359,847 | 11/1982 | Schukolinsky | 52/466 |
| 4,447,172 | 5/1984 | Galbreath | 52/396 |
| 4,589,242 | 5/1986 | Moulinié et al. | 52/396 |
| 4,773,791 | 9/1988 | Hartkorn . | |
| 4,866,898 | 9/1989 | LaRoche et al. | 52/396 |
| 4,885,885 | 12/1989 | Gottschling | 52/396 |
| 5,060,439 | 10/1991 | Clements et al. | 52/396 |
| 5,082,394 | 1/1992 | George . | |
| 5,222,339 | 6/1993 | Hendrickson et al. | 52/461 |

FOREIGN PATENT DOCUMENTS

| | | | |
|---|---|---|---|
| 219296 | 4/1987 | European Pat. Off. | 52/396 |

OTHER PUBLICATIONS

Article "Metalines Expansion & Seismic Joint Covers", pp. 4–8.

Article "C/S Group Expansion Joint Systems", pp. 14–15.

Article "MM Systems Corporation", pp. 6, 7, 12.

*Primary Examiner*—Carl D. Friedman

*Assistant Examiner*—Wynn E. Wood

*Attorney, Agent, or Firm*—Schweitzer Cornman & Gross

[57] ABSTRACT

An elastomeric seal for connecting two relatively movable architectural structures, such as floor sections, is constructed to optimize resistance to failure of the elastomeric element, in either adhesion or cohesion modes. An elastomeric seal, and an underlying support plate are provided with gently undulating, somewhat sinusoidal surface configuration, with the elastomeric element being of downwardly convex configuration and of relatively maximum thickness in its center, and of downwardly concave configuration and relatively less thickness in regions spaced on either side of center. Widthwise stretching of the elastomeric element tends to be concentrated in the regions of downwardly concave configuration, being thus not only distributed but also located away from areas of maximum vertical stress. An underlying supporting plate is provided with relatively thin, deformable edge flanges, which enable the supporting plate to function as a mold bottom, for pouring of a curable liquid elastomer at a nominal width, while at the same time allowing lateral compression of the assembly to a lesser width during normal functioning of the sealing system.

6 Claims, 1 Drawing Sheet

ELASTOMERIC SEALING SYSTEM FOR ARCHITECTURAL JOINTS

BACKGROUND AND SUMMARY OF THE INVENTION

In the design of architectural structures, it is relatively common to construct a large structure in independent segments, adjacent but spaced from each other, to allow for a degree of relative movement between the sections. Such movement may be caused by expansion and extraction factors, for example, seismic activity or the like. Typically, a suitable cover for seal is provided to span the joint between the two structures while allowing for the designed degree of relative motion. For certain types of installations, for example floors, it is advantageous to employ an elastomeric sealing element which extends between the adjacent structures. The elastomeric element is bonded at opposite sides to the structures and, in the case of floor sections, provides a relatively smooth continuation of the floor surface suitable for pedestrian traffic and light vehicles. The elastomeric element is allowed to stretch, retract, twist and distort, as necessary to accommodate the expected relative movements of the adjacent structures. One known form of such elastomeric joint seals is reflected in U.S. Pat. No. 3,849,958.

Particularly where the joint seal spans a substantial open space between the structures and/or a substantial vertical load may be expected (e.g., from light wheeled vehicles), the elastomeric sealing element is provided with a rigid support member underlying the elastomeric sealing element and supporting the same vertically while allowing the necessary sliding, stretching, retracting, twisting motions that the joint seal is required to accommodate.

Historically, architectural joints sealed with elastomeric sealing elements of the type described above have been subject to failure to a greater degree than desired. Such failures can be either cohesive failure or adhesive failure. For example, if the stresses applied at the adhesive interface exceed the adhesion bond, an adhesion failure will occur. To reduce the likelihood of adhesion failure, the elastomeric element can be configured to have a reduced cross section in the center, as reflected for example in the beforementioned U.S. Pat. No. 3,849,958. However, while this design can reduce the potential for adhesion failure, the likelihood of a cohesion failure is increased, so that one problem is traded off for another. Moreover, the seal is weakest at the center, where the vertical load stress are greatest.

Pursuant to the present invention, a novel and improved configuration of elastomeric seal and supporting element is provided, in which the bottom configuration of the elastomeric sealing element, and the conforming upper surface configuration of the underlying rigid support, is of a somewhat sinusoidal cross sectional configuration with the elastomeric seal having a section of greater thickness in the central regions. The arrangement of the invention provides for a plurality of regions, across the width of the elastomeric sealing element but spaced from the central portions thereof, in which widthwise elongation of the sealing element is facilitated. The arrangement is such that the stress level at the adhesive bond interface is minimized, while the cohesive stress of the elongation is effectively distributed, minimizing the potential for either adhesive or cohesive failure.

In an optimum form of the invention, a rigid supporting plate is provided with a concave central contour, merging with convex contours on either side thereof. A conforming elastomeric seal, typically formed by being poured in place over the supporting plate, thus is provided with a downwardly convex portion of increased thickness in its center, and downwardly concave portions of reduced thickness on either side thereof. Multiple advantages flow from this configuration, as will appear.

For a more complete understanding of the above and other features and advantages of the invention, reference should be made to the following detailed description of a preferred embodiment and to the accompanying drawing.

DESCRIPTION OF A PREFERRED EMBODIMENT OF THE INVENTION

Figure 1:
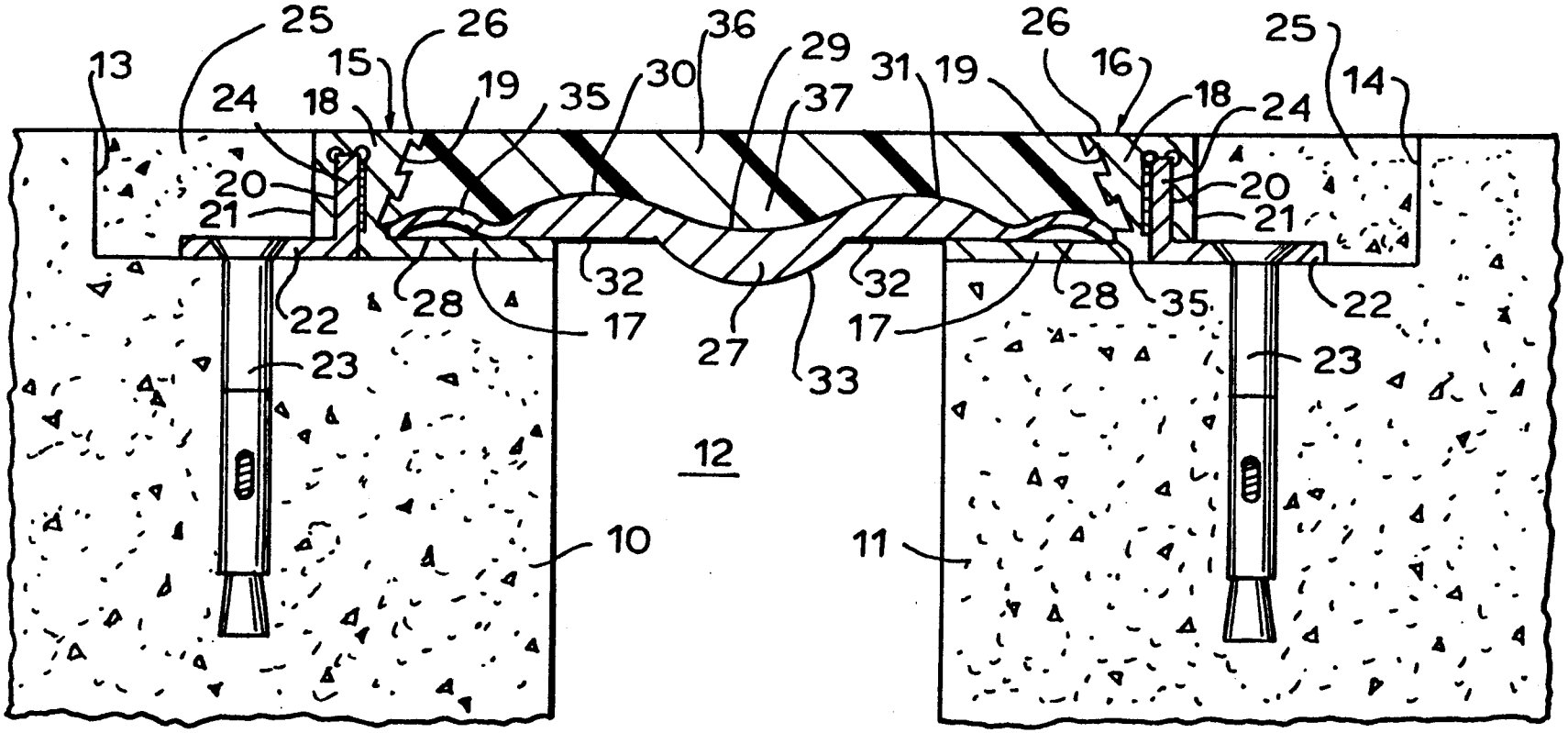
FIG. 1, is a cross sectional view of an architectural joint between two structures, sealed by an elastomeric element constructed in accordance with the principles of the invention.

Referring now to the drawing, the reference numerals 10, 11 designate respective, independently movable architectural structures, such as floor sections, separated by a space 12, which may vary according to ambient or seismic conditions, or for other reasons. Although the invention is in no way limited to specific dimensions, a typical nominal space between the two structures 10, 11 may be, for example, two inches which, with expected variations, may increase or decrease somewhat in normal use.

In a typical construction, the structures 10, 11, shown to be formed of concrete, are initially formed with shallow block-out areas 13, 14 in their upper surface areas extending along opposed edge margins of the structures. Opposed edge rail elements 15, 16 are mounted in the block-out areas 13, 14. The edge rails typically may be of extruded aluminum, for example, providing for a uniform cross section throughout their length. Each is shaped to provide a horizontal bottom flange 17 which joins with an upwardly projecting portion 18. In the the side rails are upwardly convergent and desirably are configured to provide one or more longitudinally extending dovetail slots 19.

To facilitate mounting of the edge rails 15, 16, each of the vertical portions 18 is provided with a downwardly opening vertical slot 20 having serrated internal walls 21. The slots 20 are adapted to be tightly received over L-shaped mounting clips 22 secured to the structures by anchor bolts 23. After mounting of the L-shaped brackets 22, the edge rails 15, 16 are installed by forcing the downwardly opening slots 20 over upwardly extending flanges 24 of the mounting brackets. When the edge rails are fully seated, with their bottom flanges 17 resting on and supported by the structures 10, 11, the vertical flanges 24 of the mounting brackets are tightly gripped within the slots 20, rigidly and permanently mounting the edge rails. After this operation has been completed, the open portions of the block-out areas may be filled with grout, as reflected at 25, to a level even with the upper surfaces 26 of the respective edge rail members.

Pursuant to the invention, a support member 27 of special configuration is received in the recess defined by the opposed edge rail members 15, 16 and is slidingly supported on the upper surfaces 28 of the respective flanges 17. The support plate 27, at least in its central region, is of a generally sinusoidal contour, having an upwardly concave central portion 29 and adjacent upwardly convex surface portions 30, 31 on either side. The convex and concave portions join each other smoothly, forming a somewhat gentle undulation. In a structure of the representative dimensions indicated, where the supporting plate 27 has a width on the order of four inches, the radii of the concave arc 29 and of the convex arcs 30, 31 may be on the order of one inch, for example, with their respective centers being spaced laterally a distance of, for example, about 0.8 inches.

In the illustrated and preferred form of the invention, the support plate 27 is formed with spaced-apart flat bottom surface portions 32, which are slidably supported on the flat flange surfaces 28. The illustrated plate, which is of a relatively rigid, extruded construction, provides for the centers of curvature of the convex arcs 30, 31 to be positioned about three quarters of inch below the flat surfaces 32 and for the center of the concave surface 29 to be located about one inch above the plane of those flat surfaces. To advantage, the central bottom surface portion 33 of the support plate, in the area directly opposite the concave upper surface 29, is downwardly convexly contoured to provide a relatively thick center section, for increasing the strength of the center portion of the plate 27 to better resist vertical loading.

Within the overall concepts of the invention, the support plate 27 can be provided with additional undulations. The center portion of the plate nevertheless should be upwardly concave, providing maximum thickness for the overlying elastomeric element in the center area of the space 12. For most purposes, however, an arrangement of two straddling, upwardly convex contours 30, 31, are on each side of the central concave portion 29, provides an optimum configuration.

At its opposite side edges, the support plate 27 is provided with flanges 35, which are relatively thin (e.g., about 1/16 inch) and thus easily deformable. Desirably the flanges 35 are initially pre-formed to be slightly upwardly convex to facilitate controlled deformation.

Initial preparation of the elastomeric seal structure is advantageously accomplished at the factory rather than the job site. Initially, the two side rails 15, 16 are assembled together with the supporting plate 27, in the manner shown in FIG. 1 of the drawing, with the edge extremities of the flanges 35 being abutted tightly against the inner sidewalls of the edge rails 15, 16. With the parts being firmly held in this position, a liquid elastomeric material is poured into the channel-like cavity formed by the parts, to a level flush with the upper surfaces 26 of the side rails. Desirably, the elastomer is a curable polyurethane material, although the specific elastomer is of course not critical to the invention. Prior to the pouring of the liquid elastomer, the entire upper surface of the support plate 27 is coated with a suitable release agent, if necessary, to avoid adhesion between the elastomer and the support plate. Adhesion is of course encouraged at the opposite side edges, in order to provide a strong bond between the cured elastomer 36 and the inside walls of the edge rails 15, 16. In addition, the dovetailed slots 19 provide for an element of mechanical interlocking to enhance the adhesive bond.

In a typical procedure, the entire assembly, consisting of the edge rails 15, 16, supporting plate 27 and a cured elastomeric seal 36 is taken to the job site as a preassembly and mounted in the manner previously described by forcing the open channels 20 of the edge rails over the vertical flanges 24 of the mounting brackets.

In normal operation, movement of the structures 10, 11 away from each other is accommodated by elastic elongation (in the width direction) of the elastomeric sealing element 36, which is tightly bonded at opposite side edges but relatively freely movable over the surface of the supporting plate 27. Vertical loads applied to the elastomeric element 36 are supported effectively by the strength of the supporting plate 27, which is slidably supported by the horizontal flanges 17.

During widthwise elongation of the elastomeric element 36, elastic strain tends to be concentrated in the areas generally above the upwardly convex portions of the supporting plate 27, as these are the areas of smallest cross section of the elastomeric element. Since there are at least two such areas, the elastic strain is effectively distributed, minimizing the likelihood of cohesion failure, while at the same time avoiding any penalty with respect to the possibility of adhesion failure at the opposite side edges. In addition, since the widthwise elastic strain is dispersed into a plurality of regions, the vertical thickness of the elastomeric element in these regions may be somewhat greater than otherwise, rendering the seal more resistant to the effects of vertical loading (or overloading).

Important advantages are derived from the fact that the elastomeric seal is downwardly convex and of increased thickness in its center region. One of these advantages relates to the provision for automatic centering of the supporting plate 27 without fastening or attempting to adhere the plate to the seal. Thus, as the structures 10, 11 tend to separate, the elastomeric sealing element 36 will tend to expand symmetrically with respect to its center line. Because the downwardly convex center portion 37 of the sealing element conforms to and is received in the upwardly concave central portion 29 of the supporting plate 27, the two parts tend to be mechanically interlocked in this region. Accordingly, as the elastomeric element stretches widthwise, its center portion remains generally in the center of the space 12, and tends to hold the supporting plate 27 similarly centered with respect to the intervening space. This provides for optimum supporting capability of the plate 27. Additionally, when the seal is subjected to substantial vertical loading, the center portion is apt to be subjected to the greatest stress induced from such loading. With the system of the present invention, the stress derived purely from lateral separation of the structures 10, 11 is concentrated in a plurality of regions remote from the center area of the elastomeric element, such that the stresses from lateral stretching and those vertical loading are not combined, where the vertical loading has its maximum effect. In addition, inasmuch as the horizontal stress is dispersed into at least two areas, the combined effect of the vertical horizontal stresses is significantly minimized. The end result is a substantial reduction in the likelihood of cohesion failure in the central portions of the elastomeric sealing element 36.

When the structures 10, 11 move in a converging direction from the "nominal" position, illustrated in FIG. 1, the relatively thin edge flanges 35 of the supporting plate are deformed. If the convergence of the structure is sufficient, such deformation may be permanent. However, pursuant to the invention, the deformation is confined to the relatively thin edge flange areas in a controlled and desired manner. In this respect, by pre-forming the flanges with an upwardly convex configuration, deformation resulting from convergence of the structures simply increases the degree of convexity of the flanges, as will be understood.

The provision of the deformable flanges 35 provides for significant advantages in the production phase, because the supporting plate, when initially abutted tightly against the inner sidewalls of the side rails 15, 16, seals the bottom flange surfaces 28 from the entry of the poured elastomeric material 36. With elastomeric seals of more conventional design, special provision has to be made, such as by means of masking tapes, release agents, or the like to prevent adhesion between the edge areas of the side rails and the elastomer, to accommodate the presence of the supporting plate when the structures are caused to converge. With the present construction, however, the supporting plate itself completely masks the flange surfaces 28, and convergence of the structures is accommodated by controlled collapsing or deforming of the relatively thin edge margins 35.

The elastomeric seal of the invention represents a significant improvement over known designs, particularly in the matter of dividing and distributing the points of maximum lateral stress of the elastomeric seal. The likelihood of cohesion failure in the elastomeric seal is thus reduced as a result not only of the distribution of the stress to two different areas, but also the location of those areas well away from the center of the open space between the adjacent structures.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An architectural joint system connecting two spaced-apart, relatively movable structures and of the type including spaced-apart edge rail elements mounted on the respective structures, support means spanning the space between said structures, and an elastically extensible elastomeric sealing element secured by the edge rail elements and spanning said space directly above and supported by said support means, wherein (a) said support means comprises a generally rigid plate-like member extending between and movably supported by said spaced-apart edge rail elements, (b) said plate-like member having an upwardly concave central cross sectional contour in its central region and upwardly convex cross sectional contours immediately adjacent said central cross sectional contour, (c) said central cross sectional contour and said adjacent, upwardly convex cross sectional contours forming a gently undulating, sinusoid-like upper surface configuration of said plate-like member in the regions where said plate-like member spans the space between said structures, (d) said elastomeric sealing member being directly supported by and initially having lower surface contours complementary to the upper surface contours of said plate-like member, whereby said sealing member is of greater thickness in its central region than in regions thereof on either side of said central region, (e) said sealing member being secured at opposite side edges hereof to said side rail members and being movable with respect to said plate-like member in response to relative movements of said structures.

2. An architectural joint system according to claim 1, wherein (a) said elastomeric sealing member has a thickness, in the region thereof which is generally centered with respect to said space, which is greater than the thickness of said sealing member is regions above said upwardly convex contours of said plate-like member, whereby resistance to lateral elastic extension of said sealing member is less in the regions thereof located above said upwardly convex contours than in the region thereof above said upwardly concave contours.

3. An architectural joint system according to claim 1, wherein (a) said plate-like member has laterally outwardly extending edge flanges of relatively thinner cross section than center portions of said member, (b) said edge flanges being initially formed with an upwardly convex contour, (c) said edge flanges being inwardly and upwardly deformable upon sufficient converging displacement of said structures and said edge rail elements.

4. An architectural joint system connecting two spaced-apart, relatively movable structures and of the type including spaced-apart edge rail elements mounted on the respective structures, support means spanning the space between said structures, and an elastically extensible elastomeric sealing element secured by the edge rail elements and spanning said space directly above and supported by said support means, wherein (a) said spaced-apart edge rail elements comprise generally horizontal flange portions, extending toward said space, and upwardly extending portions adjoining outer portions of said flange portions, (b) said support means comprises a generally rigid plate-like member movably supported by and extending between said generally horizontal flange portions, (c) said plate-like member having laterally outwardly extending, deformable opposite side edge flanges of relatively less thickness than more central portions of said plate-like member, (d) said side edge flanges initially being positioned in substantially abutting relation to said upwardly extending portions whereby said plate-like member covers said generally horizontal flange portions, (e) said plate-like member and said upwardly extending portions forming an upwardly opening channel-shaped mold for receiving a curable liquid elastomer.

5. An architectural joint system according to claim 4, wherein (a) said side edge flange are preformed to have upwardly convex contour and being deformable upwardly and inwardly upon relative converging movement of said structures.

6. An architectural joint system connecting two spaced-apart, relatively movable structures and of the type including spaced-apart edge rail elements mounted on the respective structures, support means spanning the space between said structures, and an elastically extensible elastomeric sealing element secured by the edge rail elements and spanning said space directly above and supported by said support means, wherein (a) said support means comprises a generally rigid plate-like member formed with a gently undulating, sinusoid-like upper surface contour, (b) said elastomeric sealing element is formed with a lower surface contour which, when the sealing element is unstressed in the lateral direction, conforms closely to the surface contour of said plate-like member, and (c) a center region of said elastomeric sealing element is of greater thickness than regions thereof adjacent thereto on either side.

* * * * *